US005154370A

United States Patent [19]

Cox et al.

[11] Patent Number: 5,154,370

[45] Date of Patent: Oct. 13, 1992

[54] HIGH LIFT/LOW DRAG WING AND MISSILE AIRFRAME

[75] Inventors: James W. Cox, Arlington, Tex.; Matthew S. Smith, Burbank, Calif.; Herbert H. Driggers, Grand Prairie, Tex.

[73] Assignee: The United States of America as represented by the Secretary of the Air Force, Washington, D.C.

[21] Appl. No.: 730,329

[22] Filed: Jul. 15, 1991

[51] Int. Cl.[5] ..... F42B 10/00; F42B 10/14

[52] U.S. Cl. ..... 244/3.27; 244/3.28; 244/16

[58] Field of Search ..... 244/3.24, 3.26, 3.27, 244/3.28, 3.29, 119, 16

[56] References Cited

U.S. PATENT DOCUMENTS

| | | | |
|---|---|---|---|
| 1,348,983 | 8/1920 | Covino | 244/119 |
| 2,074,099 | 3/1937 | Adams | 244/47 |
| 2,643,076 | 6/1953 | Hurel | 244/16 |
| 2,667,351 | 1/1954 | McKinney, Jr. et al. | 244/16 |
| 2,961,928 | 11/1960 | Rosenthal | 89/1.7 |
| 3,020,986 | 2/1962 | Kirk et al. | 189/34 |
| 3,063,375 | 11/1962 | Hawley et al. | 102/50 |
| 3,098,445 | 7/1963 | Jackson | 244/3.28 |
| 3,145,000 | 8/1964 | Mackie | 244/123 |
| 3,415,467 | 12/1968 | Barringer | 244/3.29 |
| 3,416,756 | 12/1968 | Windecker | 244/123 |
| 3,468,501 | 9/1969 | Baum | 244/137.4 |
| 3,567,407 | 3/1971 | Yoblin | 29/191.4 |
| 3,971,535 | 7/1976 | Jones | 244/46 |
| 4,000,871 | 1/1977 | DeHaai | 244/119 |
| 4,296,894 | 10/1981 | Schnäbele et al. | 244/3.27 |
| 4,408,737 | 10/1983 | Schwaerzler | 244/100 D |
| 4,471,923 | 9/1984 | Hoppner et al. | 244/63 |
| 4,542,866 | 9/1985 | Caldwell et al. | 244/89 |
| 4,605,183 | 8/1986 | Gabriel | 244/91 |
| 4,832,288 | 5/1989 | Kendall et al. | 244/3.24 |
| 4,836,470 | 6/1989 | Criswell | 244/2 |
| 4,842,218 | 6/1989 | Groutage et al. | 244/3.28 |

*Primary Examiner*—Joseph F. Peters, Jr.
*Assistant Examiner*—Virna Lissi Mojica
*Attorney, Agent, or Firm*—William G. Auton; Donald J. Singer

[57] ABSTRACT

An air launched, air-to-surface missile which has extended range and reduced radar cross section for low observability is disclosed. The design uses a triangular cross section fuselage, for low profile drag and reduced weight, a very high aspect ratio, such as 22.5, folding wing for low induced drag and three folding tail fins for less profile drag. The wing is a composite structure of graphite/epoxy sparcaps and 2024 aluminum alloy core with glass/epoxy skins and full depth Nomex.

3 Claims, 3 Drawing Sheets

HIGH LIFT/LOW DRAG WING AND MISSILE AIRFRAME

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to aircraft, and more specifically the invention pertains to a missile airframe and high L/D wing design for the 2000 lb. class of air launched air-to-surface missile applications.

It is known that a substantial increase of the lift to drag ratio of an airfoil can be obtained by increasing the geometric aspect ratio of the wing system of the airfoil, since the induced drag decreases as the aspect ratio increases. With respect to air launched air-to-air missiles, improvements in the design of the fuselage, wings and fins can potentially provide extended standoff range as well as potential for low radar cross section, and low carriage drag. The increase in standoff range provides increased air craft survivability without reducing payload weight on target.

The task of providing a missile airframe and high L/D wing design with extended standoff range, low radar cross section and low carriage drag is alleviated, to some extent, by the systems disclosed in the following U.S. Patents, the disclosure of which are specifically incorporated by reference:

U.S. Pat. No. 2,074,099 issued to Adams;
U.S. Pat. No. 2,643,076 issued to Hurel;
U.S. Pat. No. 2,961,928 issued to Rosenthal;
U.S. Pat. No. 3,020,986 issued to Kirk et al;
U.S. Pat. No. 3,063,375 issued to Hawley et al;
U.S. Pat. No. 3,145,000 issued to Mackie;
U.S. Pat. No. 3,416,756 issued to Windecker;
U.S. Pat. No. 3,567,407 issued to Yoblin;
U.S. Pat. No. 4,000,871 issued to De Haai; and
U.S. Pat. No. 4,471,923 issued to Hoppner et al.

The patent of Adams illustrates a fuselage of triangular shape formed by two upper longerons and a single lower longeron. A somewhat similar structure was used in the fuselage of an airplane produced during the late 1920s by the Fairchild company that incorporated two bottom longerons and a single top longeron. It gained the nick-name "Razorback".

The more recently issued patent to DeHaai discloses a high speed aircraft having a fuselage using two lower spaced apart tubular longerons and a single upper longeron. The use of high aspect ratio wings to achieve reduced drag is common practice in certain classes or aircraft such as sailplanes.

The reference Hurel suggests aspect ratios higher than 15 and possibly as high as 30, 40 or more can be used. The use of folding wings for projectiles or missiles is old as shown by the patents to Rosenthal and to Hoppner et al. The use of folding fins or tail surfaces on a missile is shown for example, by the reference Hawley et al. The remaining references Kirk et al, Mackie, Windecker and Yoblin all illustrate use of composite materials in aircraft construction.

While the above-cited references are instructive, the need remains to provide a missile design with the extended standoff range, low radar cross section, and low carriage drag features mentioned above. The present invention is intended to satisfy that need.

SUMMARY OF THE INVENTION

The present invention includes a new design for an air launched, air-to-surface missile which has extended range and reduced radar cross section for low observability. The design uses a triangular cross section fuselage, a very high aspect ratio, such as 22.5, folding wing, and three folding tail fins for less profile drag.

The purpose of the triangular cross-section body is to offer a lower drag conformal carriage. This design offers the potential for reduced radar cross-section while providing extended range capability.

The high aspect ratio wing provides low induced drag. Prior to use, the folding high aspect ratio wing is stowed on one of the three sides. The carriage attachment is stored on one of the other sides. The three fins are also stowed on the sides. A conformal carriage can be achieved in this invention when it is placed against a flat surface on the launch aircraft.

In one embodiment of the invention, the triangular cross-section is sized to carry three 5.2-inch diameter submunitions per sector. The missile may be propelled by three solid fueled rocket engines which are stacked in the back of the fuselage in the form of a triangle. Additionally, the missile may be propelled by a single solid fueled rocket engine which is housed in the back of the fuselage. The improved performance of the invention is a product of the airframe design, including the high aspect ratio foldable wing, folding tail fins, and triangular fuselage.

Once the wing of the aircraft is deployed, the missile may be operated in either a regular flight mode, or a yawed flight mode. In the regular flight mode, the gliding wing extends at a perpendicular angle with respect to the missile. In one application of this system, it will provide a particular missile with a cruising velocity of 390 knots and a normal Mach number of 0.654 at 20,000 feet.

In the yawed flight mode, the wings are tilted at a yaw angle with respect to the body of the missile. In one embodiment of the invention, a 2 position actuator with an intermediate stop is used to tilt the wing to a 45 degree yaw angle, with the beneficial results discussed below.

In operation, the missile should avoid exceeding its critical velocity because the air flow around the vehicle will abruptly change from a smooth viscous flow to an unstable eddy flow and generate flight instability. In the missile system described above, the critical velocity in the regular flight mode is 400 knots.

When a missile equipped with the present invention finds itself exceeding the critical velocity of 400 knots, the following corrective action can be taken. When the wings are tilted at a yaw angle of 45 degrees) the critical velocity is increased to 550 knots, and as long as the vehicle is traveling below 550 knot/hour, the air medium will continue in a smooth viscous flow over the missile, and instability will be avoided.

Accordingly, the invention both extends the range of endoatmospheric missiles, by providing gliding wings, and corrects for flight instability by increasing the critical velocity when needed.

It is an object of the present invention to provide a design for an air launched, air-to-surface missile which has extended range by virtue of its airfoil design.

It is another object of the present invention to provide a missile design with low carriage drag.

it is another object of the present invention to provide a missile design with low radar cross section, for reduced observability by hostile forces and increased aircraft survivability.

It is another object of the present invention to increase missile survivability without reducing its payload weight.

These objects together with other objects, features and advantages of the invention will become more readily apparent from the following detailed description when taken in conjunction with the accompanying drawing wherein like elements are given like reference numerals throughout.

DETAILED DESCRIPTION OF THE PREFERRED EMBODIMENT

The present invention includes a design for a missile airframe with a high L/D foldable wing for an air launched air-to-surface missile.

Figure 1:
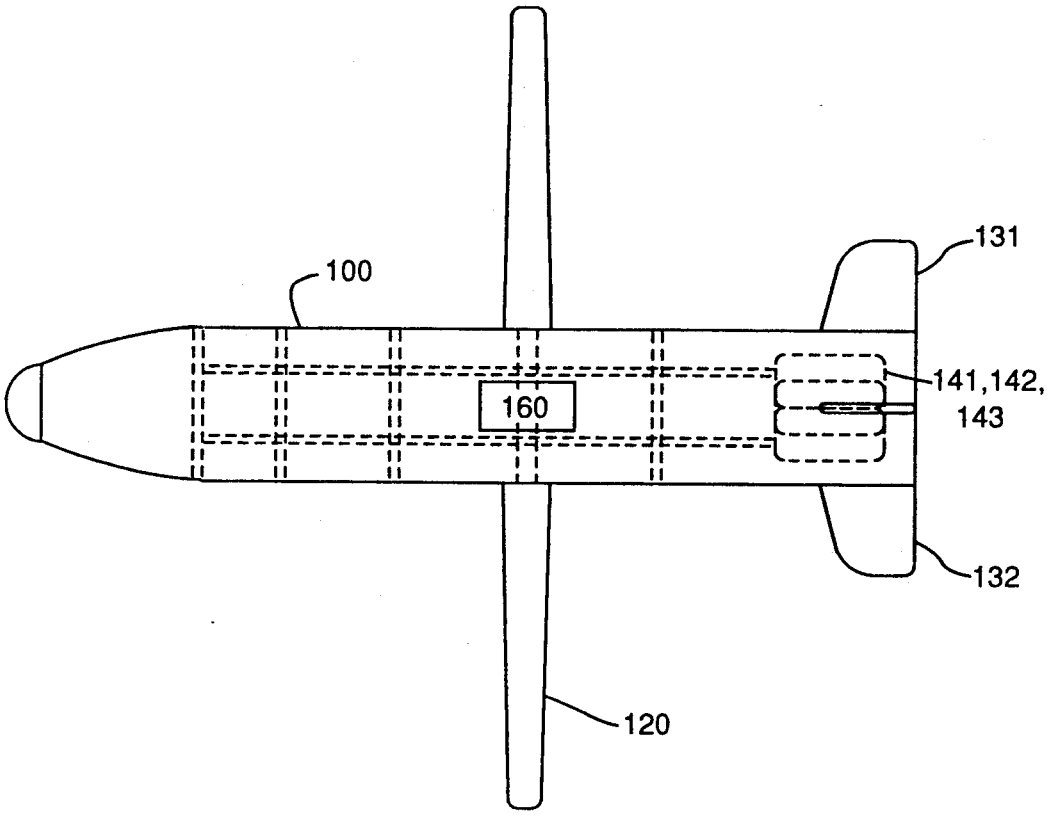
FIG. 1–3 are illustrations which respectively depict a plan view, a side view, and an aft view of the present invention.
Figure 2:
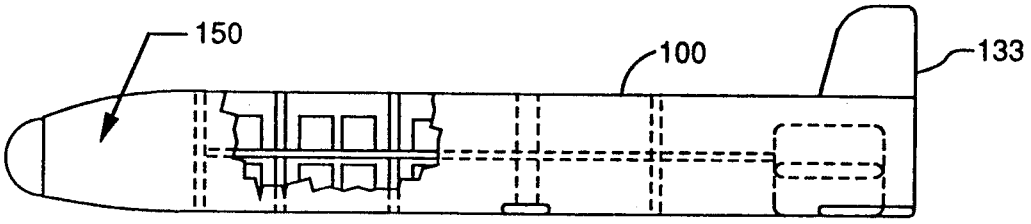
Figure 3:
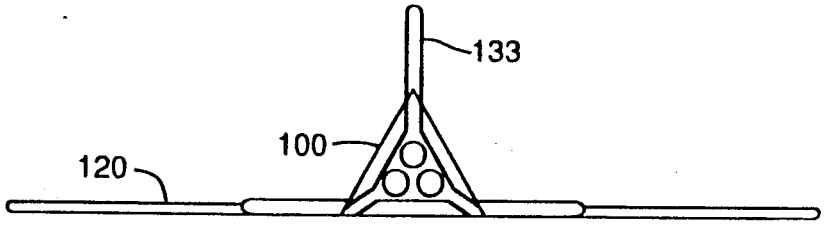

The readers attention is now directed towards FIGS. 1–3, which are illustrations which respectively depict: a plan view of the invention; a side view of the invention; and an aft view of the invention. The design features of each aspect of the invention is discussed in detail below with reference to these Figures.

FIG. 1 is a plan view of the present invention which depicts: a triangular cross-section fuselage 100; a folding high aspect ratio wing 120 attached to the fuselage; and three folding tail fins 131–133 fixed to the aft end of the fuselage.

The embodiment of FIGS. 1–3 is an actual design intended for the 2000 lb. class of air launched air-to-surface missile. It is propelled by three sustain solid fueled motors 141–143 housed in the aft end of the fuselage. As indicated by the aft view of FIG. 3, the three solid fueled motors are stacked in a triangular configuration so that they are circumscribed by the fuselage. In practice, these engines are commercially available and each have a 5.2 inch diameter and burn time of 165 seconds and a thrust of 170 pounds. When properly air launched, these motors are combined with the missile design to deliver a low altitude range of 30 nautical miles; and a high altitude range of 90 nautical miles. This extended range is a direct concometant, consequent and result of the airfoil design of the missile, as described below.

Returning to FIG. 1, the foldable wing 120 may be extended to provide a twelve foot span. This results in the high aspect ratio of 22.5 A variety of wing folding mechanisms 160 are known in the art that may be adapted to extend the foldable wing 120 and fins 131–133. More specifically, the above-cited Rosenthal reference discloses a folding wing projectile with lock wings and folding fins. It is believed that a further description of the servomechanisms that extend and retract the wing 120 and fins 131–133 is unnecessary other than to note that the machinery and engines that retract and extend the wing and fins is expected to be housed within the fuselage 100. In operation, the wing should be launched with the wing initially stowed, and deployed during flight when the sustain rocket motors are ignited. One way in which the wing could be initially stored flat against the base of the fuselage is simply to pivotally connect the wing at its center to the base of the fuselage. When stored, the wing would be aligned with the fuselage, and then rotate to extend.

In one embodiment of the invention, the folding high aspect wing 120 is stowed on one of the three sides, such as the bottom of the fuselage. Similarly, the three fins can also be stowed on the sides if they are each pivotally connected to one of the corners of the triangular shaped fuselage 100. Conformal carriage can be achieved when placed against a flat surface on the launch aircraft. The use of the triangular cross-section body offers a lower drag conformal carriage. This design also offers the potential for reduced radar cross-section while providing extended range capability.

As mentioned above, one embodiment of the invention serves as an air launched air-to-surface missile. In this embodiment, the triangular cross-section is sized to carry three 5.2-inch diameter sumunitions per sector, with three sectors per cross-section and fifteen total. Conventional explosives are used as the submunition elements, and these need not be described further. Similarly, a conventional guidance system 150 is housed in the nose section of the missile.

Figure 4:
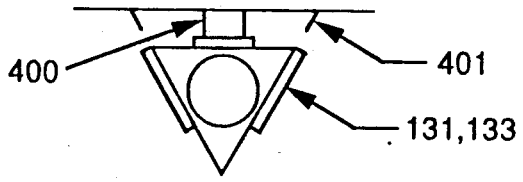
FIG. 4 is a forward view of the missile with its folding wing and fins in the stored position.

FIG. 4 is a forward view of the missile when stored which shows the flat surface of the triangular shaped body can also be used in a semi-conformal carriage configuration. In this case, the weapon is mounted on a stubby pylon 400 (extends only a few inches from the aircraft surface). Fairings 401 are used between the aircraft surface and weapon to reduce interference and pylon drag. Analysis has shown that for the semiconformal configuration the drag is significantly reduced. The range of this design is approximately 50% greater than a conventional cruciform wing design with double the rocket motor size. The radar cross section of the missile from the front view is 0.02 square meters.

Figure 5:
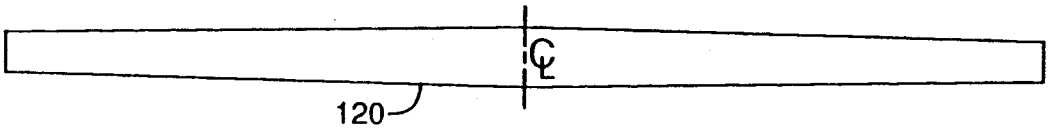
FIG. 5 is a plan view of the folding wing.
Figure 6:
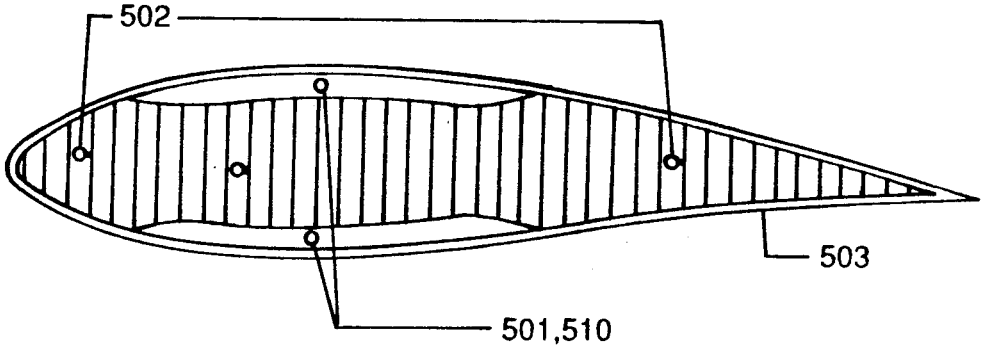
FIG. 6 is a section view of the wing of FIG. 5.

FIG. 5 is a plan view of the high aspect ratio wing 120 near the center of the load. FIG. 6 is a sectional view of the wing of FIG. 5, when extended. The present invention features a high aspect ratio wing that is stored for aircraft carriage and extends after launch. The design provides extended range because of the high aspect ratio wing that yields high lift-to-drag ratios. The wing is made of graphite/epoxy sparcaps 501 and 2024 aluminum core 502 with glass epoxy skins 503 and full depth Nomex core. The total wing weight is estimated to be approximately 20 pounds based on a launch weight of 2000 pounds.

As indicated in FIG. 5, the span of the folding wing is 12 feet. The chord line of the wing at the center of the load is about 6.88 inches, and is 4.88 inches as the wing tip. These dimensions result in the high aspect ratio of 22.5 for one embodiment of the wing of the present invention.

Once the wing of the aircraft is deployed, the missile may be operated in either a regular flight mode, or a yawed flight mode. In the regular flight mode, the gliding wing extends at a perpendicular angle with respect to the missile as shown in FIG. 1. In one application of this system, it will provide a particular missile with a cruising velocity of 390 knots and a normal Mach number of 0.654 at 20,000 feet.

Figure 7:
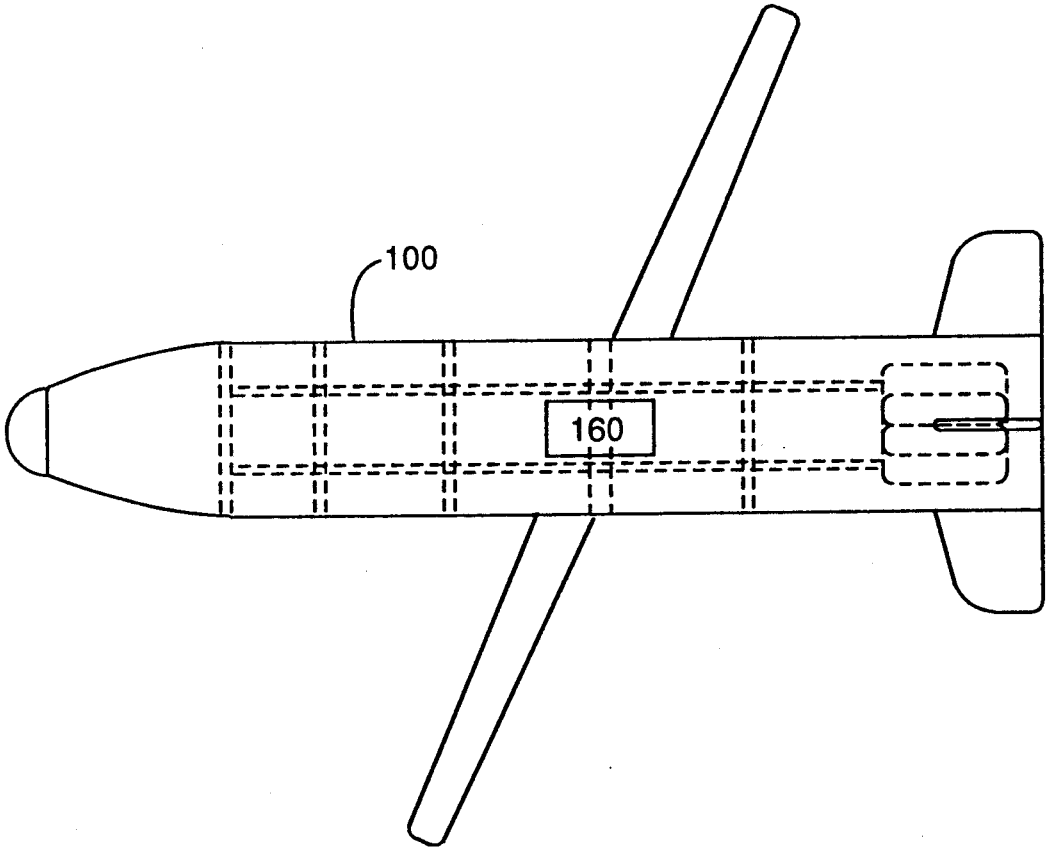
FIG. 7 is an illustration of the invention used in the yawed flight mode.

FIG. 7 is an illustration of the invention used in the yawed flight mode. In the yawed flight mode, the wings are tilted at a yaw angle with respect to the body of the missile. In one embodiment of the invention, a 2 position actuator with an intermediate stop is used to tilt the wing to a 45 degree yaw angle, with the beneficial results discussed below.

In operation, the missile should avoid exceeding its critical velocity because the air flow around the vehicle will abruptly change from a smooth viscous flow to an unstable eddy flow and generate flight instability. In the missile system described above, the critical velocity in the regular flight mode is 400 knots.

When a missile equipped with the present invention finds itself exceeding the critical velocity of 400 knots, the following corrective action can be taken. When the wings are tilted at a yaw angle of 45 degrees the critical velocity is increased to 550 knots, and as long as the vehicle is traveling below 550 knots/hour, the air medium will continue in a smooth viscous flow over the missile, and instability will be avoided.

Accordingly, the invention both extends the range of endoatmospheric missiles, by providing gliding wings, and corrects for flight instability by increasing the critical velocity when needed. Table 1 is a chart of the aerodynamic properties of the missile system of FIG. 1 in the normal flight mode.

TABLE 1

1. Velocity Range
390 knots to stall speed
2. Yaw Angle $\psi=0$

3. Critical velocity $H=20{,}000\ Ft.$ $Vcr=400\ knots$

4. Aspect Ratio $$AR=\frac{b^2}{s}$$

Table 2 is a chart of the aerodynamic properties of the same missile, when operated in the yawed flight mode, as shown in FIG. 7.

TABLE 2

1. Velocity Range $M=1.2\ to\ 390\ knots$

2. Yield Angle
45°
3. Critical Velocity $H=20{,}000\ FT$ $Vcr=550\ knots$ $Mn=0.634$, *normal flow Mach number*

4. Aspect Ratio $AR=0.5\ b^2/s$

As shown in the comparison of Table 1 to Table 2, the aspect ratio is changed and the critical velocity is increased when the aircraft switches from the normal flight mode to the yawed flight mode. Both the deployment of the wings and the adjustment to yawed flight is accomplished using the wing actuator unit 160 of FIGS. 1 and 7. The wing actuator unit 160 is a motor-driven pivotal mount which causes the wings to fit flush against the missile body, and allows them to be rotated out to the desired angle with respect to the missile body.

One system which provides a wing adjustment system is described in the folding wing projectile patent of the above-cited Rosenthal reference. More modern wing deployment mechanisms are used by modern jet fighters as well as the systems disclosed in the following U.S. Pat. Nos., the disclosures of which are specifically incorporated herein by reference:

U.S. Pat. No. 4,836,470 issued to Criswell;
U.S. Pat. No. 4,605,183 used to Gabriel;
U.S. Pat. No. 4,408,737 issued to Schwaerzler; and
U.S. Pat. No. 3,971,535 issued to Jones.

The Criswell reference describes an air vehicle with a rotatable flying wing, which is similar to Gabriel's swing wing glider. The Jones reference describes an oblique wing supersonic aircraft, and suggests that further details of a particular wing actuator unit need not be described in order to enable one skilled in the art to practice this aspect of the invention.

While the invention has been described in its presently preferred embodiment it is understood that the words which have been used are words of description rather than words of limitation and that changes within the purview of the appended claims may be made without departing from the scope and spirit

What is claimed is:

1. A missile which comprises:

a triangular shaped fuselage having a base, two sides, a nose section, and an aft section; said triangular shaped fuselage having a low radar cross section when in flight and low drag characteristics;

a means for propelling said missile, said propelling means being housed in said triangular shaped fuselage in the aft end;

a means of reguiding said missile, said guiding means being housed in said triangular shaped fuselage;

a high aspect ratio folding wing which is stored flat against said triangular shaped fuselage at launch, and which extends after said propelling means is activated to provide extended range to said missile with low drag, wherein said high aspect ratio wing is pivotably connected to said missile so that it projects perpendicularly from said aircraft during a normal flight mode, and may be tilted at a yaw angle with respect to said missile in a yaw flight mode, said yaw angle reducing the high aspect ratio wing's aspect ratio and increasing the missile's critical velocity and stability at rates of travel near the critical velocity;

a set of three folding fins which are folded in said triangular shaped fuselage on its aft end, and which extend after launch, wherein each of said three folding fins is pivotally connected to a point of a triangle formed by the aft end of said triangular shaped fuselage, said folding fins thereby being able to fold flat against the two sides and the base of said triangular shaped fuselage to minimize its drag and radar cross section prior to launch; and a means for extending said set of folding fins and said high aspect ratio following wings.

2. A missile which may be launched from an aircraft, and which comprises:

a triangular shaped fuselage having a base, two sides, a nose section, and an aft section; said triangular shaped fuselage having a low radar cross section when in flight and low drag characteristics;

a means for propelling said missile, said propelling means being housed in said triangular shaped fuselage in the aft end;

a means of reguiding said missile, said guiding means being housed in said triangular shaped fuselage;

a high aspect ratio folding wing which is stored flat against said triangular shaped fuselage at launch, and which extends after said propelling means is activated to provide extended range to said missile with low drag, wherein said high aspect ratio wing is pivotably connected to said missile so that it projects perpendicularly from said aircraft during a normal flight mode, and may be tilted at a yaw angle with respect to said missile in a yaw flight mode, said yaw angle reducing the high apse ct ratio wing's aspect ratio and increasing the missile's critical velocity and stability at rates of travel near the critical velocity;

a set of three folding fins which are folded in said triangular shaped fuselage on its aft end, and which extend after launch, wherein each of said three folding fins is pivotally connected to a point of a triangle formed by the aft end of said triangular shaped fuselage, said folding fins thereby being able to fold flat against the two sides and the base of said triangular shaped fuselage to minimize its drag prior to launch;

a means for extending said set of folding fins and said high aspect ratio folding wings;

a stubby pylon which connects said triangular shaped fuselage to said aircraft and which detaches when said fuselage is launched; and a set of fairings disposed between said triangular shaped fuselage and said aircraft on either side of said stubby pylon, said fairings, said stubby pylon, said high aspect ratio folding wing and said set of folding fins thereby adding minimum drag to said aircraft and adding minimum additional radar cross section to the aircraft prior to launch.

3. A missile which may be launched from an aircraft, and which a triangular shaped fuselage having a base, two sides, a nose section, and an aft section; said triangular shaped fuselage having a low radar cross section when in flight and low drag characteristics;

a means for propelling said missile, said propelling means being housed in said triangular shaped fuselage in the aft end;

a means of reguiding said missile, said guiding means being housed in said triangular shaped fuselage;

a high aspect ratio folding wing which has an aspect ratio of about 22.5, and which is stored flat against said triangular shaped fuselage at launch, and which extends after said propelling means is activated to provide extended range to said missile with low drag, wherein said high aspect ratio wing is pivotably connected to said missile so that it projects perpendicularly from said aircraft during a normal flight mode, and may be tilted at a yaw angle with respect to said missile in a yaw flight mode, said yaw angle reducing the high apse ct ratio wing's aspect ratio and increasing the missile's critical velocity and stability at rates of travel near the critical velocity;

a set of three folding fins which are folded in said triangular shaped fuselage on its aft end, and which extend after launch, wherein each of said three folding fins is pivotally connected to a point of a triangle formed by the aft end of said triangular shaped fuselage, said folding fins thereby being able to fold flat against the two sides and the base of said triangular shaped fuselage to minimize its drag prior to launch;

a means for extending said set of folding fins and said high aspect ratio folding wings;

a stubby pylon which connects said triangular shaped fuselage to said aircraft and which detaches when said fuselage is launched; and a set of fairings disposed between said triangular shaped fuselage and said aircraft on either side of said stubby pylon, said fairings, said stubby pylon, said high aspect ratio folding wing and said set of folding fins thereby adding minimum drag to said aircraft and adding minimum additional radar cross section to the aircraft prior to launch.

* * * * *